US009986355B2

(12) United States Patent
Pare et al.

(10) Patent No.: US 9,986,355 B2
(45) Date of Patent: May 29, 2018

(54) ASSEMBLY AID FOR MINIATURE TRANSDUCER

(71) Applicant: Bose Corporation, Framingham, MA (US)

(72) Inventors: Christopher A. Pare, Franklin, MA (US); David W. Beverly, Lunenburg, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days. days.

(21) Appl. No.: 15/182,014

(22) Filed: Jun. 14, 2016

(65) Prior Publication Data

US 2017/0359665 A1 Dec. 14, 2017

(51) Int. Cl.

| | |
|---|---|
| ***H04R 1/02*** | (2006.01) |
| ***H04R 31/00*** | (2006.01) |
| ***H04R 9/04*** | (2006.01) |
| ***H04R 7/04*** | (2006.01) |
| ***H04R 9/06*** | (2006.01) |

(52) U.S. Cl.

CPC ..... *H04R 31/006* (2013.01); *H04R 7/04* (2013.01); *H04R 9/04* (2013.01); *H04R 9/06* (2013.01); *H04R 2201/029* (2013.01)

(58) Field of Classification Search

CPC ... H04R 9/04; H04R 31/006; H04R 2201/029
See application file for complete search history.

(56) References Cited

U.S. PATENT DOCUMENTS

| | | | | |
|---|---|---|---|---|
| 2,094,043 | A | 9/1937 | Marshall | |
| 5,748,758 | A * | 5/1998 | Menasco, Jr. | H04R 23/00 381/173 |
| 8,107,665 | B2 | 1/2012 | Haapapuro et al. | |
| 2005/0276434 | A1 | 12/2005 | Kobayashi et al. | |
| 2008/0240486 | A1* | 10/2008 | Garcia | H04R 1/1016 381/380 |
| 2009/0152655 | A1* | 6/2009 | Laming | B81C 1/00246 257/416 |
| 2009/0304212 | A1* | 12/2009 | Han | H04R 19/013 381/191 |
| 2012/0210560 | A1* | 8/2012 | Tsai | H04R 31/00 29/592.1 |
| 2012/0319219 | A1* | 12/2012 | Diamond | H04R 19/005 257/416 |
| 2013/0058515 | A1 | 3/2013 | Akino | |
| 2014/0232236 | A1* | 8/2014 | Atkins | H04R 7/08 310/300 |

OTHER PUBLICATIONS

International Search Report and Written Opinion in International Patent Application No. PCT/US17/35161, dated Aug. 31, 2017; 14 pages.

* cited by examiner

*Primary Examiner* — Tuan D Nguyen
(74) *Attorney, Agent, or Firm* — Schmeiser, Olsen & Watts LLP

(57) ABSTRACT

An electroacoustic transducer comprises a sleeve extending along a longitudinal axis; a diaphragm coupled to the sleeve at a first end of the sleeve; a subassembly in the sleeve; and an alignment element extending from the subassembly in a direction substantially away from the diaphragm.

10 Claims, 5 Drawing Sheets

ASSEMBLY AID FOR MINIATURE TRANSDUCER

BACKGROUND

This description relates generally to transducers for noise canceling headphones, and more specifically, to precision alignment techniques and aids for assembling electroacoustic transducers.

BRIEF SUMMARY

In accordance with one aspect, an electroacoustic transducer comprises a sleeve extending along a longitudinal axis; a diaphragm coupled to the sleeve at a first end of the sleeve; a subassembly in the sleeve; and an alignment element extending from the subassembly in a direction substantially away from the diaphragm.

Aspects may include one or more of the following features:

The subassembly may comprise a magnet and a back plate, the magnet being located between the diaphragm and the back plate. The alignment element may extend from the back plate in a direction substantially away from the diaphragm.

The alignment element may have a width that is less than a width of the back plate. The alignment element may extend from a center region of the back plate.

The alignment element may extend from the back plate along the longitudinal axis in a direction of a second end of the sleeve opposite the first end.

The alignment element may be constructed and arranged for communication with an external alignment apparatus for aligning the subassembly in the sleeve during assembly of the electroacoustic transducer.

The electroacoustic transducer may further comprise a circuit board at the second end of the sleeve. The circuit board may include an opening. The alignment element may extend through the opening in the circuit board, and aligning the circuit board relative to a surface of the sleeve.

The electroacoustic transducer may further comprise a cavity between the circuit board and the back plate. The alignment element may extend along the longitudinal axis from the back plate through the cavity to the opening in the circuit board.

The electroacoustic transducer may further comprise a gap between a periphery of the back plate and an interior wall of the sleeve, a distance between uniform about the periphery of the back plate from the periphery of the back plate and the interior wall of the sleeve; and an adhesive in the gap surrounding the periphery of the back plate and securing the back plate to the sleeve.

The adhesive may be a rigid, quick curing adhesive.

In accordance with another aspect, an alignment element of an electroacoustic transducer comprises a first portion constructed and arranged for coupling to the electroacoustic transducer, the first portion having a substantially planar surface extending in a first direction of extension, the first portion having a first width; and a second portion having a length extending from the first portion in a second direction of extension perpendicular to the first direction of extension, the second portion having a width that is less than the width of the first portion.

Aspects may include one or more of the following features:

The first portion may include a back plate constructed and arranged for positioning at a sleeve of the electroacoustic transducer.

The back plate may include a plurality of vent holes about a periphery of the back plate.

The back plate may directly abut and be flush against a sleeve of the electroacoustic transducer.

The alignment element may further comprise a gap between a periphery of the back plate and an interior wall of the sleeve, a distance between uniform about the periphery of the back plate from the periphery of the back plate and the interior wall of the sleeve; and an adhesive in the gap surrounding the periphery of the back plate and securing the back plate to the sleeve.

The alignment element may be constructed and arranged for communication with an external alignment apparatus for aligning the subassembly in the sleeve during assembly of the electroacoustic transducer.

The alignment element may be constructed and arranged to extend through an opening in a circuit board at the end of a transducer sleeve, and align the circuit board relative to a surface of the transducer sleeve.

In accordance with another aspect, a method for assembling an electroacoustic transducer comprises coupling a diaphragm to a sleeve; attaching a voice coil to the diaphragm; providing a subassembly for communicating with the diaphragm and the voice coil, the subassembly including a magnet, a back plate, and an alignment element extending from the back plate; and coupling the alignment element to an alignment apparatus for aligning the subassembly in the sleeve relative to the voice coil and the diaphragm.

Aspects may include one or more of the following features:

The method may further comprise applying an adhesive to at least one of the back plate or an interior of the sleeve; and aligning the subassembly in the sleeve prior to curing of the adhesive.

The method may further comprise coupling a printed circuit board to the sleeve, the alignment element extending through an opening in the printed circuit board.

The alignment element may extend from a back plate in a direction away from the diaphragm. The method may further comprise coupling the back plate to the subassembly.

BRIEF DESCRIPTION

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Modern in-ear headphones, or earbuds, typically include a microspeaker, referred to as an electro-acoustic driver or transducer, attached to a diaphragm that pushes the air around it and creates a sound that is output to a user. In doing so, the microspeaker must produce a sufficient sound pressure over the entire frequency range over which the device will be used.

An electroacoustic transducer of an in-ear headphone is typically assembled by aligning a feature of one individual component of the miniature transducer with a feature of another neighboring component. One example is the alignment of a magnet subassembly inside a transducer housing with respect to a voice coil, bobbin, surround, and/or related elements of the transducer. Often, an internal assembly gauge such as a shim may be used to align components with each other.

For miniature transducers, for example, those found in active noise reduction (ANR) in-ear headphones, the individual component sizes are too small to rely on the features of the components to give reliably consistent mating conditions. Alignment gauges are inadequate since they are fragile due to the miniature size requirement needed for aligning components in the interior of the miniature transducers. In other words, alignment gauges may be limited or otherwise be prevented from insertion in the transducer housing to perform a precise alignment of the subassembly components in the miniature transducer housing, for example, due to lack of access.

In accordance with some examples, an assembly aid, referred to as an alignment element or "nub", extends from a back plate of a transducer structure so that the back plate may be fixtured, aligned, calibrated, adjusted, or otherwise moved within the housing, or sleeve, of a miniature transducer by a large piece of alignment equipment, obviating the need to reduce the size of the alignment device for insertion inside the transducer sleeve and rendering it prone to the deficiencies mentioned above. The insertion of the subassembly in the housing in a miniature transducer in a "blind" manner necessitates the presence of the alignment element. Transferring the precision of the alignment from a micro-sized component feature to a macro-sized piece of equipment in this manner for performing alignment externally to the miniature transducer yields the required degree of precision alignment necessary for a high performance miniature transducer.

Another benefit is that the assembly of a transducer is improved where the magnets in a magnet assembly are pre-magnetized before assembly. Due to the large side forces on the magnets, a rigid, external alignment fixture apparatus is important to ensuring precise alignment of the magnet assembly with respect to the transducer sleeve.

Figure 1:
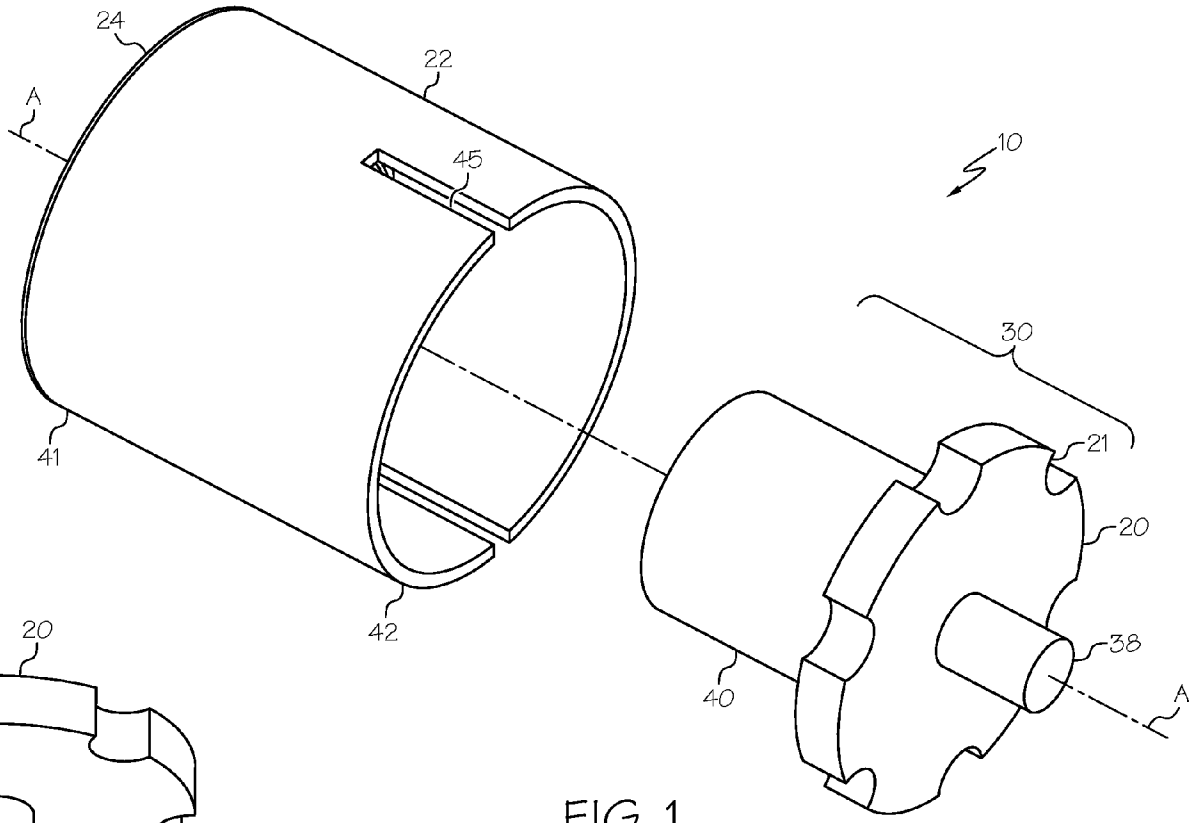
FIG. 1 is an exploded perspective view of an electroacoustic transducer, in accordance with some examples.
Figure 2:
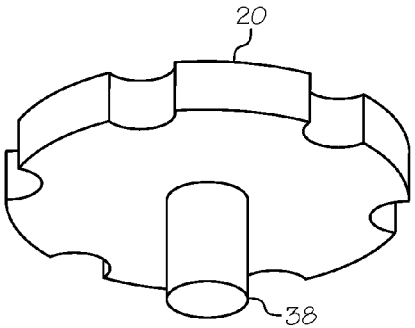
FIG. 2 is a perspective view of a back plate and alignment element of the electroacoustic transducer of FIG. 1.

Referring to FIG. 1, an electroacoustic transducer 10 comprises a sleeve 22, a diaphragm 24, a subassembly 30, and an alignment element 38. The sleeve 22 extends along a longitudinal axis (A). In some examples, the sleeve 22 has a cylindrical shape or the like, but is not limited thereto. The sleeve 22 may include one or more openings 45 through which a voice coil leadout wire (not shown) may extend.

The sleeve 22 includes a first end 41 about which the diaphragm 24 is positioned, and a second end 42 at which the subassembly 30 is inserted. The diaphragm 24 can be coupled to the first end 41 of the sleeve 22 by bonding, adhesives, or other well-known attachment technique. In other examples, not shown, a suspension element, sometimes referred to as a surround, may be positioned between the diaphragm 24 at a periphery of the first end 41 of the sleeve 22. Although the diaphragm 24 is shown as having a substantially flat profile, it is not limited thereto. For example, the diaphragm may be dome-shaped, or other shape for permitting the diaphragm 24 to produce desirable sounds. The surround and diaphragm 24 may be constructed as a single component or as separate components, allowing the diaphragm 24 to move in a reciprocating manner in response to an electrical current applied to a voice coil 35 positioned in the sleeve 22. In other examples, the diaphragm 24 may have different stiffnesses or the like, for example, having a central region that is more stiff than a peripheral region of the diaphragm 24.

Figure 4:
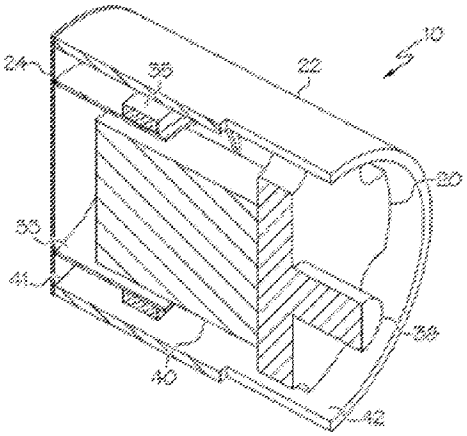
FIG. 4 is an assembled perspective view of the electroacoustic transducer of FIGS. 1-3, taken along a cross-section.
Figure 5:
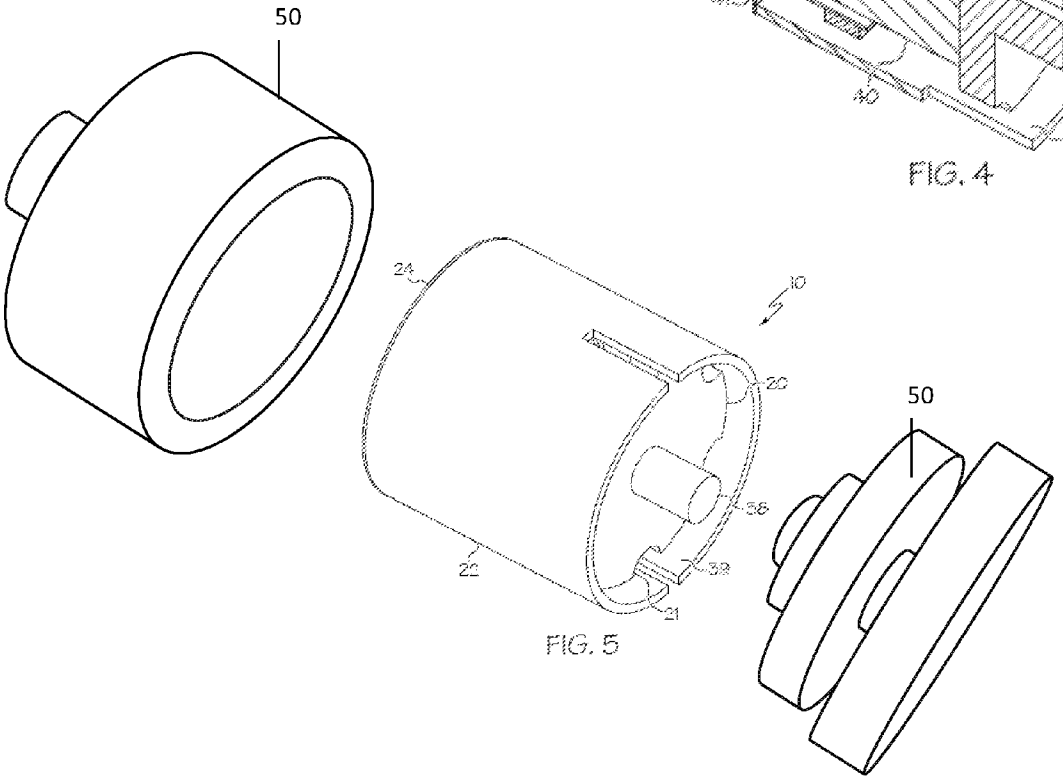
FIG. 5 is an assembled perspective view of the electroacoustic transducer of FIG. 4.

In some examples where the magnet of the motor assembly 40 is positioned inside a voice coil 35, as shown in FIG. 4, the outside diameter of the sleeve 22 is less than about 8 mm. In some examples, the sleeve 22 has an outside diameter that is less than about 4.5 mm. In other examples, the sleeve 22 has an outside diameter that is between about 3.0 mm and 4.5 mm. In other examples, the sleeve 22 has an outside diameter that is between about 3.3 mm and 4.2 mm. In other examples, the sleeve 22 has an outside diameter that is between about 3.6 mm and 3.9 mm. In some examples, the magnet has a diameter that is between about 1.5 mm and 4.5 mm. In other examples, the magnet has a diameter that is between about 2.0 mm and 4.0 mm. In other examples, the magnet has a diameter that is between about 2.5 mm and 3.5 mm. In some examples, a ratio of the radiating area to total cross sectional area of the driver is about 0.7. In some examples, a ratio of the radiating area to total cross sectional area of the driver is between 0.57-0.7. In some examples, a ratio of the radiating area to total cross sectional area of the driver is between 0.6-0.67. In some examples, a ratio of the radiating area to total cross sectional area of the driver is between 0.62-0.65.

As shown in FIG. 4, a back plate 20 of the subassembly 30 can be coupled to the second end 42 of the sleeve 22 by bonding, adhesives, or other well-known attachment technique, for example, applying an adhesive between a peripheral surface of the back plate 20 and an interior surface of the sleeve 22. The back plate 20 may include a plurality of vent holes 21 formed about a periphery of the back plate 20. A combination of the vent holes 21 and the cavity 39 may contribute to, or shape, a frequency response of the transducer 10. The subassembly 30 may be aligned in the sleeve 22, for example, by an external alignment device 50 removably attached to the alignment element 38, prior to curing an adhesive applied to at least one of the back plate 20 and/or an interior of the sleeve 22, until the adhesive cures.

An example of an external alignment device 50 may include an alignment fixture that has a substantially collinear headstock and tailstock and permits axial motion along the axis of collinearity, and further has provisions for securing both the sleeve 22 and the nub 38 in a position centered around the axis of collinearity such that the only allowable motion is axially along the axis of collinearity.

In some examples, the back plate 20 may directly abut and be flush against the interior wall of the sleeve 22. In other examples, a gap may be present between a periphery of the back plate 20 and the interior wall of the sleeve 20. Here, the gap is filled by the adhesive.

The alignment device when communicating with the alignment element 38 can be used to align the back plate 20 so that the outermost edge, i.e., 360 degrees, of the back plate 20 is a uniform distance, i.e., equidistant, from the interior wall of the sleeve 22. The adhesive may cure after a desired alignment within predetermined and acceptable tolerances is achieved. The adhesive preferably includes a rigid and reasonably quick curing adhesive. The amount of adhesive between the interior wall of the sleeve 22 and surface of the back plate 20 is therefore substantially uniform about the periphery of the back plate 20. The sleeve 22 is constructed and arranged for positioning the subassembly 30 a predetermined fixed distance and orientation from the diaphragm 24 and/or other driver elements positioned in the sleeve 22, for example, shown in FIGS. 3 and 4 as including a bobbin 33 and voice coil 35.

Figure 3:
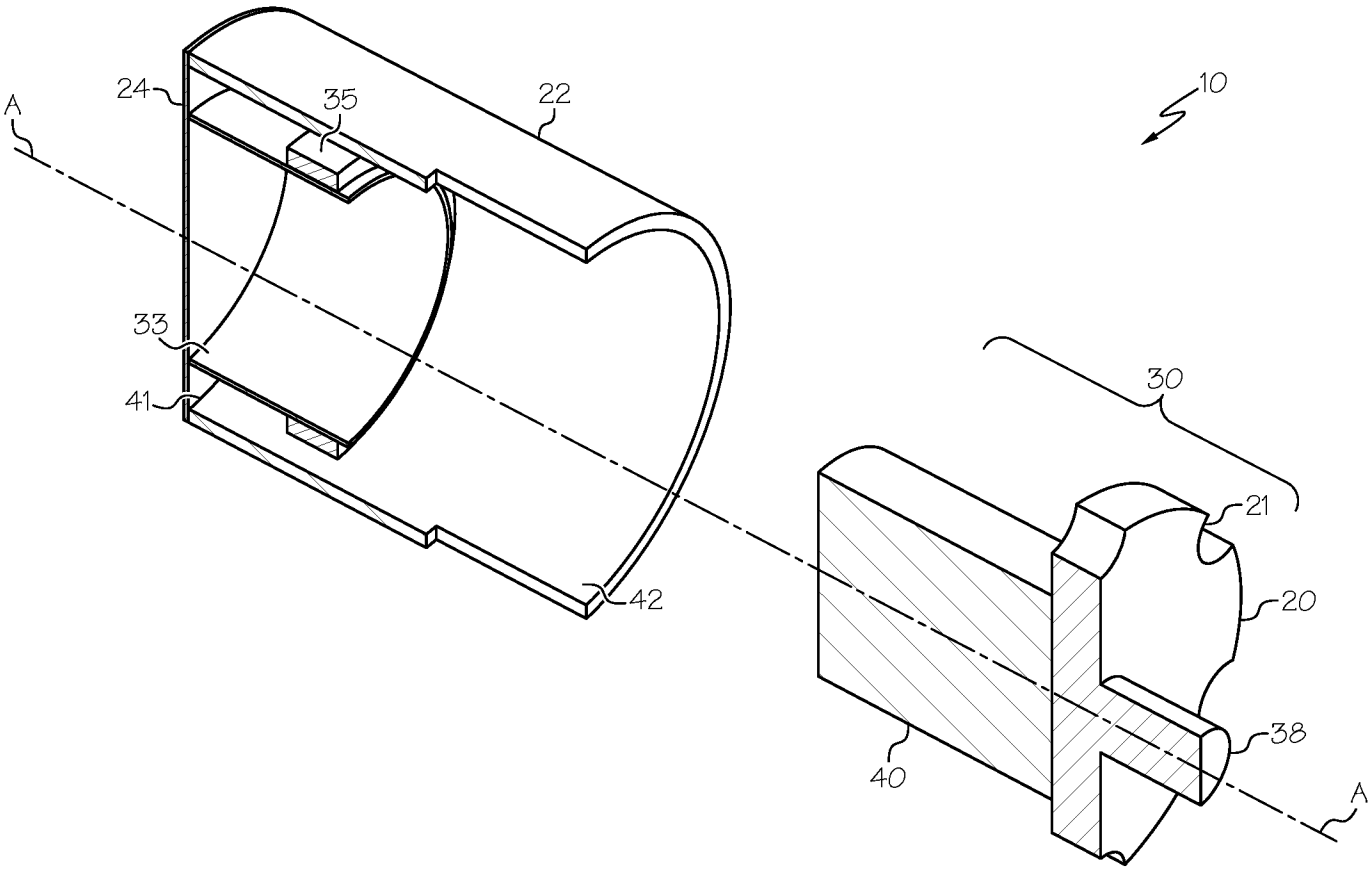
FIG. 3 is another exploded perspective view of the electroacoustic transducer of FIG. 1, taken along a cross-section.

As shown in the example of FIGS. 3 and 4, the subassembly 30 may comprise a motor assembly 40, the back plate 20, and an alignment element 38, which may be coupled together to form an integral unit.

The motor assembly 40 is constructed and arranged for positioning between the diaphragm 24 and the back plate 20. The motor assembly 40 comprises one or more permanent magnets, which are configured to provide a predetermined magnetic field for a desired speaker output.

The back plate 20 has a substantially planar surface extending in a direction of extension that is aligned to be substantially perpendicular to a direction of extension, or longitudinal axis (A), of the sleeve 22. The alignment element 38 extends from the back plate 20 in a directly substantially away from the diaphragm 24. The alignment element 38 and back plate 20 may be formed separately, and coupled to each other, for example, by bonding, adhesives, threaded screw, or the like. Alternatively, the alignment element 38 and back plate 20 may be integral, for example, formed of a common metal stock, injection mold, and so on. In other examples, the back plate 20 and alignment element 38 are integral with the motor assembly 40. For example, the back plate 20 can include a pole piece (not shown) that extends from a side of the back plate 20 opposite the alignment element 38 towards the diaphragm 24 such that the voice coil 35 is positioned about the pole piece.

In some examples, the alignment element 38 extends along a same direction of extension, or longitudinal axis (A), as the sleeve 22 such that the alignment element 38 is substantially parallel to the wall of the sleeve 22, and/or the direction of extension of the back plate 20 is perpendicular to the direction of extension (A) of the sleeve 22. The alignment element 38 is constructed and arranged for communication with an alignment apparatus for aligning the subassembly 30 in the sleeve 22 during assembly of the electroacoustic transducer 10. More specifically, the alignment element 38 is removably coupled to an alignment apparatus for aligning the subassembly in the sleeve relative to the voice coil 35 and the diaphragm 24, for example, aligning the subassembly 30 at a required depth, angle, concentricity, and so on inside the sleeve 22, and to ensure that the motor assembly 40 is properly aligned relative to the voice coil 35 inside the sleeve 35. The alignment element 38 may be cylindrical as shown, or of another shape that permits an external alignment apparatus or tool, for example, described herein, to perform an alignment operation with respect to the assembly of a miniature transducer.

Figure 6:
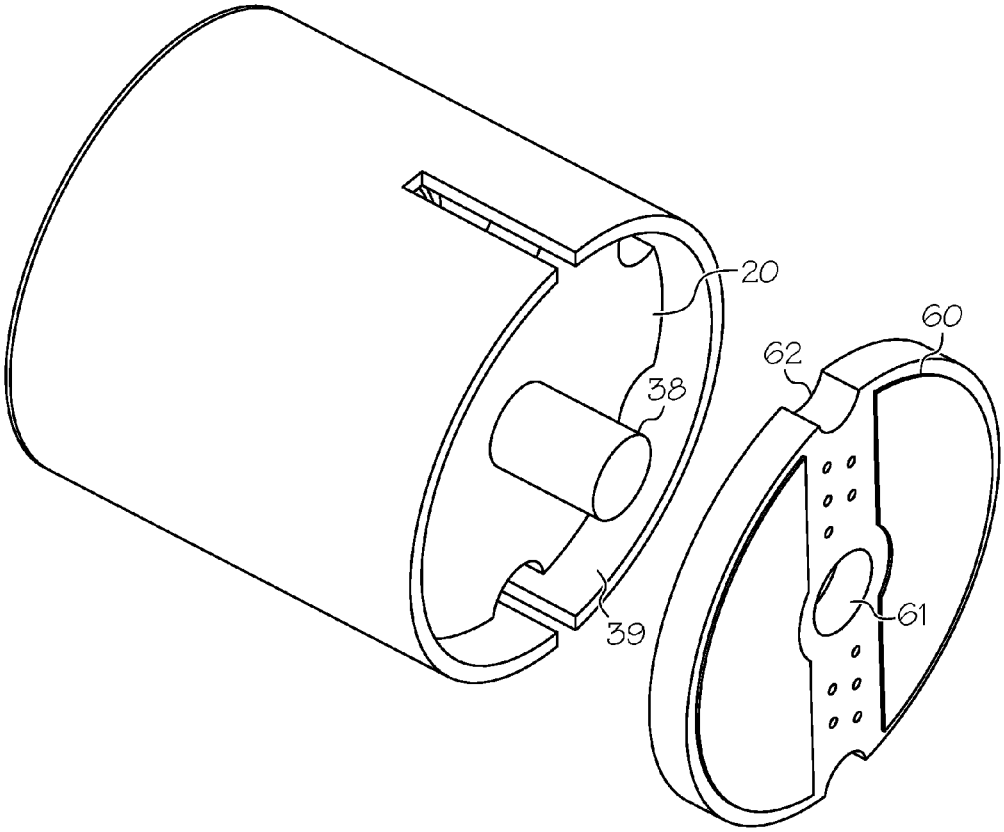
FIG. 6 is a perspective view of the electroacoustic transducer of FIGS. 1-5 including a separate printed circuit board (PCB), in accordance with some examples.
Figure 7:
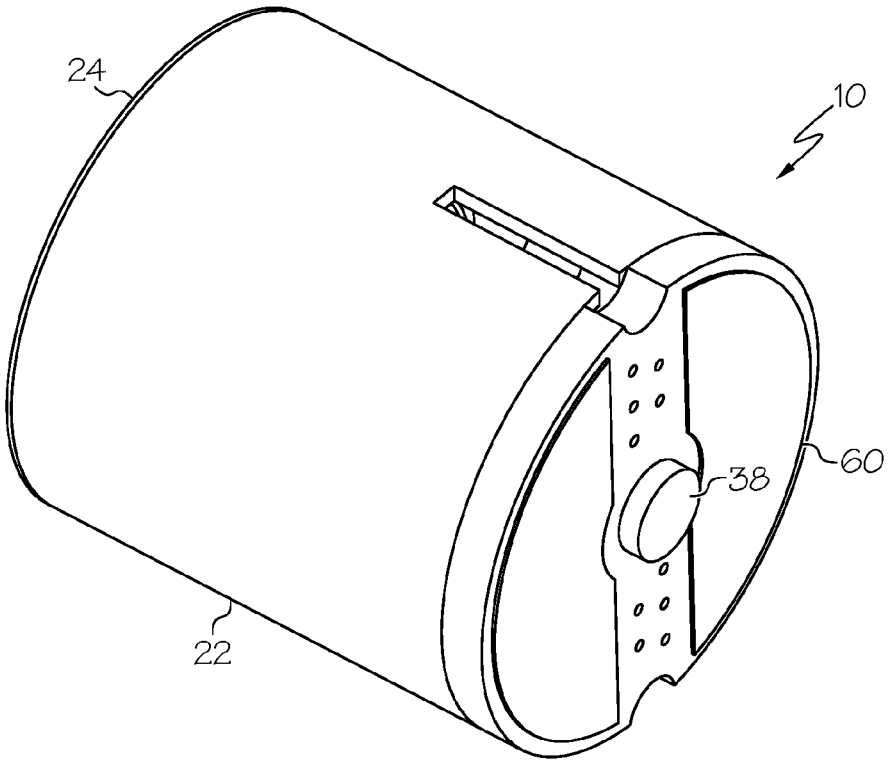
FIG. 7 is a perspective view of the electroacoustic transducer of FIG. 6 including the printed circuit board (PCB) coupled to the transducer.
Figure 8:
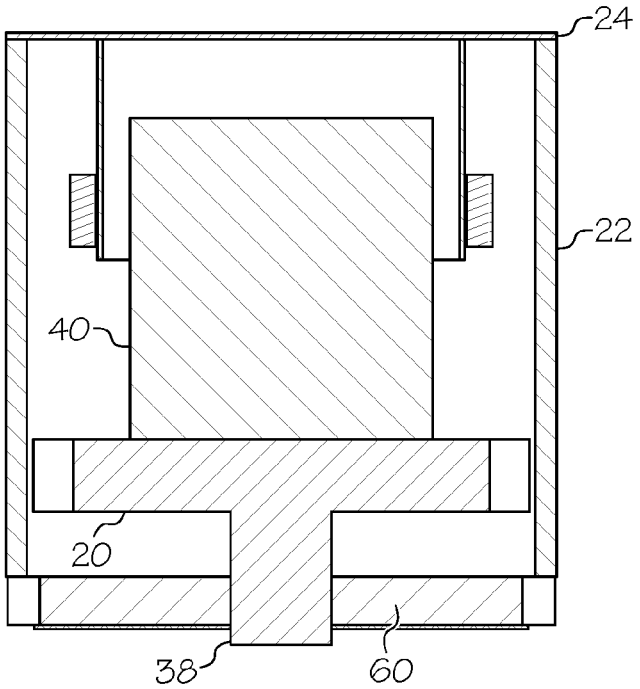
FIG. 8 is a front view of the electroacoustic transducer of FIGS. 6 and 7, taken along a cross-section.

As shown in FIGS. 6 and 7, a printed circuit board (PCB) 60 can be coupled to a second end of the sleeve 22, for example, by bonding, adhesives, or other coupling technique. The PCB 60 can include an opening 61, for example, at a substantial center of the PCB 60, wherein the alignment element 38 can extend through the opening in the PCB 60. The alignment element 38 can operate to align the PCB 60, for example, so that the entire outermost edge, i.e., 360 degrees, of the PCB 60 is a uniform distance from the sleeve 22. To achieve this, the alignment element 61 may have a width, diameter, or other geometry that is less than that of the back plate 20.

The electroacoustic transducer 10 may include a cavity 39 that separates the PCB 60 and the back plate 20 by a predetermined distance. The alignment element 38 extends along the longitudinal axis (A) from the back plate 20 through the cavity 39 to the PCB 60.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. An electroacoustic transducer, comprising:

a sleeve extending along a longitudinal axis;

a diaphragm coupled to the sleeve at a first end of the sleeve;

a subassembly in the sleeve, the subassembly comprising a magnet and a back plate, the magnet between the diaphragm and the back plate; and an alignment element extending from the back plate in a direction away from the diaphragm and the magnet, wherein:

the back plate includes a plurality of vent holes about a periphery of the back plate;

the electroacoustic transducer further comprises a cavity between the back plate and a second end of the sleeve; and the alignment element extends along the longitudinal axis from a center region of the back plate surrounded by the vent holes and through the cavity and the second end of the sleeve.

2. The electroacoustic transducer of claim 1, wherein the alignment element has a width that is less than a width of the back plate.

3. The electroacoustic transducer of claim 1, wherein the alignment element extends from the back plate along the longitudinal axis in a direction of the second end of the sleeve opposite the first end.

4. The electroacoustic transducer of claim 1, wherein the alignment element is constructed and arranged for communication with an external alignment apparatus for aligning the subassembly in the sleeve during assembly of the electroacoustic transducer.

5. The electroacoustic transducer of claim 4, further comprising a voice coil in the sleeve, wherein the alignment element is removably coupled to the external alignment apparatus for aligning the subassembly in the sleeve relative to the voice coil and the diaphragm.

6. The electroacoustic transducer of claim 5, wherein the subassembly includes a motor assembly, and wherein the alignment element is removably coupled to the external alignment apparatus to align the motor assembly relative to the voice coil inside the sleeve.

7. The electroacoustic transducer of claim 1, further comprising a circuit board at the second end of the sleeve, the circuit board including an opening, the alignment element extending through the opening in the circuit board, and aligning the circuit board relative to a surface of the sleeve.

8. The electroacoustic transducer of claim 7, wherein the cavity is between the circuit board and the back plate, the alignment element extending along the longitudinal axis from the back plate through the cavity to the opening in the circuit board.

9. The electroacoustic transducer of claim 1, further comprising:

a gap between a periphery of the back plate and an interior wall of the sleeve, a distance being uniform about the periphery of the back plate from the periphery of the back plate and the interior wall of the sleeve; and an adhesive in the gap surrounding the periphery of the back plate and securing the back plate to the sleeve.

10. The electroacoustic transducer of claim 9, wherein the adhesive is a rigid, quick curing adhesive.

* * * * *